US007395555B2

(12) United States Patent
Aldridge et al.

(10) Patent No.: US 7,395,555 B2
(45) Date of Patent: Jul. 8, 2008

(54) GARMENT WITH STORAGE POUCH

(75) Inventors: Donald Aldridge, New Carlisle, OH (US); Harry P. Winer, Holliston, MA (US)

(73) Assignees: Lion Apparel, Inc., Dayton, OH (US); The United States of America as represented by the Secretary of the Navy, Washington, DC (US)

( * ) Notice: Subject to any disclaimer, the term of this patent is extended or adjusted under 35 U.S.C. 154(b) by 685 days.

(21) Appl. No.: 10/749,760

(22) Filed: Dec. 31, 2003

(65) Prior Publication Data

US 2005/0144695 A1 Jul. 7, 2005

(51) Int. Cl.
*A41D 13/00* (2006.01)

(52) U.S. Cl. ..... 2/69; 2/93; 2/79; 224/576; 224/577

(58) Field of Classification Search ..... 2/69, 2/69.5, 79, 94, 108, 115, 93; 224/576, 577, 224/586, 683; 383/4
See application file for complete search history.

(56) References Cited

U.S. PATENT DOCUMENTS

| | | | | | |
|---|---|---|---|---|---|
| 1,905,235 | A | * | 4/1933 | Mandelert | 2/94 |
| 2,002,955 | A | | 5/1935 | Lipson | |
| 2,248,455 | A | * | 7/1941 | Freund | 2/94 |
| 2,292,347 | A | * | 8/1942 | Bailey | 2/93 |
| 2,437,223 | A | * | 3/1948 | Dutrow | 2/94 |
| 2,834,966 | A | | 5/1958 | Zimmerman | |
| 4,042,976 | A | | 8/1977 | Reynolds | |
| 4,476,587 | A | * | 10/1984 | Itoi | 2/94 |
| 4,485,489 | A | | 12/1984 | Pilié et al. | |
| 4,502,155 | A | * | 3/1985 | Itoi | 2/115 |
| 4,700,409 | A | * | 10/1987 | De Lott | 2/94 |
| 4,944,042 | A | * | 7/1990 | DeWan | 2/94 |
| 4,985,936 | A | | 1/1991 | Jones | |
| 5,040,243 | A | | 8/1991 | Tatsuno | |
| 5,090,054 | A | | 2/1992 | Grilliot et al. | |
| 5,115,517 | A | | 5/1992 | Ferguson et al. | |
| 5,274,850 | A | | 1/1994 | Aldridge | |
| 5,309,571 | A | | 5/1994 | Huang | |

(Continued)

FOREIGN PATENT DOCUMENTS

| | | |
|---|---|---|
| FR | 2594009 | 8/1987 |

(Continued)

OTHER PUBLICATIONS

International Preliminary Report on Patentability issued regarding International Application No. PCT/US04/42599 (Feb. 12, 2008).

*Primary Examiner*—Katherine Moran
*Assistant Examiner*—Richale L Quinn
(74) *Attorney, Agent, or Firm*—Thompson Hine LLP

(57) ABSTRACT

A foldable protective garment including an outer shell shaped to fit about at least part of the body of a wearer, the outer shell being foldable into a compact position, and a pouch coupled to the outer shell. The pouch is shaped and sized to receive generally all of the outer shell therein when the outer shell is in the compact position. The pouch includes an upper mouth and a lower mouth located on a generally opposite side of the pouch relative to the upper mouth, and the upper mouth and the lower mouth are both selectively openable and closable.

41 Claims, 10 Drawing Sheets

U.S. PATENT DOCUMENTS

| | | | | | |
|---|---|---|---|---|---|
| 5,331,685 | A | | 7/1994 | Belgard | |
| 5,410,758 | A | | 5/1995 | Dupont et al. | |
| 5,539,932 | A | | 7/1996 | Howard | |
| 5,564,125 | A | | 10/1996 | Waldman et al. | |
| 5,575,010 | A | | 11/1996 | Chung | |
| 5,606,746 | A | | 3/1997 | Shelton et al. | |
| 5,673,836 | A | * | 10/1997 | Bush | 224/576 |
| 5,873,132 | A | | 2/1999 | Grilliot et al. | |
| 5,920,905 | A | * | 7/1999 | Aldridge | 2/81 |
| 5,924,134 | A | * | 7/1999 | Taylor et al. | 2/81 |
| 5,960,473 | A | | 10/1999 | Tajima | |
| 6,026,516 | A | | 2/2000 | Dacyshyn | |
| 6,058,508 | A | | 5/2000 | Brown Honeysuckle | |
| 6,305,027 | B2 | | 10/2001 | Chou | |
| 6,341,384 | B1 | * | 1/2002 | Hayes | 2/458 |
| 6,405,377 | B1 | * | 6/2002 | Davis | 2/94 |
| 6,425,138 | B1 | | 7/2002 | Johnson | |
| 6,477,711 | B1 | | 11/2002 | Freeman et al. | |
| 6,564,388 | B1 | * | 5/2003 | Poston | 2/86 |
| 6,848,118 | B2 | * | 2/2005 | Barnes et al. | 2/108 |
| 7,013,496 | B2 | * | 3/2006 | Dunn | 2/458 |
| 2003/0000003 | A1 | | 1/2003 | Boersema | |

FOREIGN PATENT DOCUMENTS

| | | |
|---|---|---|
| GB | 2333949 | 8/1999 |
| JP | 10192028 | 7/1998 |

* cited by examiner

GARMENT WITH STORAGE POUCH

The present invention is directed to a protective garment, and more particularly, to a protective garment having a pouch in which the protective garment may be stored.

BACKGROUND

Protective or hazardous duty garments are widely used in various industries to protect the wearer from various hazardous conditions, such as heat, smoke, cold, sharp objects, chemicals, liquids, fumes and the like. Such garments may include materials which should be stored in a protective pouch. For example, protective garments may be made of or include aramid or other material which should be shielded from light in order to protect the materials. Furthermore, storing the garment in a protective pouch protects the garment from fumes and chemicals. Folded protective garments which are stored in a pouch are also more compact and therefore require less space and are easier to stow.

It may be desired to have a storage pouch that is fixedly coupled to the garment so that the storage pouch does not become separated from the garment and is always available for immediate use. However, due to the bulk nature of protective garments it may be difficult to fit protective garments into pouches. Accordingly, there is a need for garment having a storage pouch wherein the garment can be quickly and easy stored in the storage pouch and which can be quickly and easily removed from the storage pouch.

SUMMARY

In one embodiment, the present invention is a garment having a storage pouch wherein the garment can be quickly and easy stored in the storage pouch and which can be quickly and easily removed from the storage pouch. In particular, in one embodiment the invention is a foldable protective garment including an outer shell shaped to fit about at least part of the body of a wearer, the outer shell being foldable into a compact position, and a pouch coupled to the outer shell. The pouch is shaped and sized to receive generally all of the outer shell therein when the outer shell is in the compact position. The pouch includes an upper mouth and a lower mouth located on a generally opposite side of the pouch relative to the upper mouth, and the upper mouth and the lower mouth are both selectively openable and closable.

These and other objects and advantages of the present invention will be apparent from the following description, the accompanying drawings and the appended claims.

DETAILED DESCRIPTION

Figure 1:
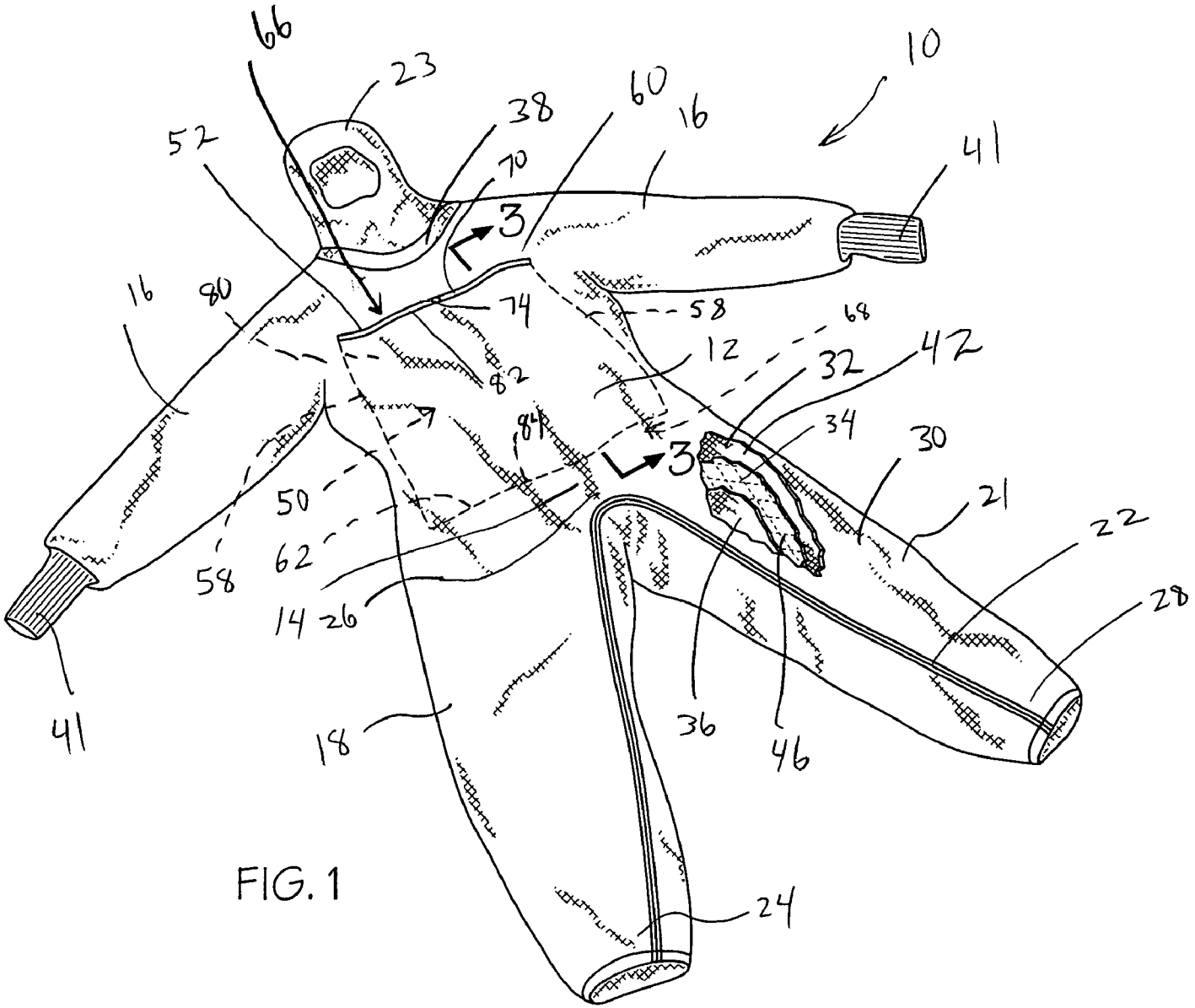
FIG. 1 is a front perspective view of one embodiment of the protective garment of the present invention, with part of the garment cut away to show the various layers thereof.

FIG. 1 illustrates a protective or hazardous duty garment in the form of a garment or body suit, generally designated 10. The garment 10 may include a torso portion 12 shaped to cover or be located adjacent to the torso of a wearer and waist portion 14 shaped to cover or be located adjacent to the waist of a wearer. The garment 10 may also include a pair of sleeves or arms 16 and a pair of legs 18, 21, shaped to cover or be located adjacent to the arms and legs, respectively, of the wearer. The garment 10 may include a hood 23 shaped to fit over the head of a wearer.

The garment 10 may include a releasable fastener 22 (such as a zipper or the like) which extends from the ankle 24 of leg 18, up and around the crotch 26, and to the ankle 28 of leg 21. The fastener 22 can be opened to fully open the legs 18, 21 (see FIG. 5) so that the garment 10 can be donned doffed by passing the garment 10 over the head and shoulders of a wearer. However, the garment 10 may have any of a wide variety of configurations, openings, fasteners (i.e. slide fastener components, snaps, buttons, hook and loop fastening systems (i.e. VELCRO®), straps, ties and the like) which can be located in a variety of locations (i.e., across the chest of the garment 10, along the side of the garment 10, etc.) to enable donning and doffing of the garment 10.

Figure 3:
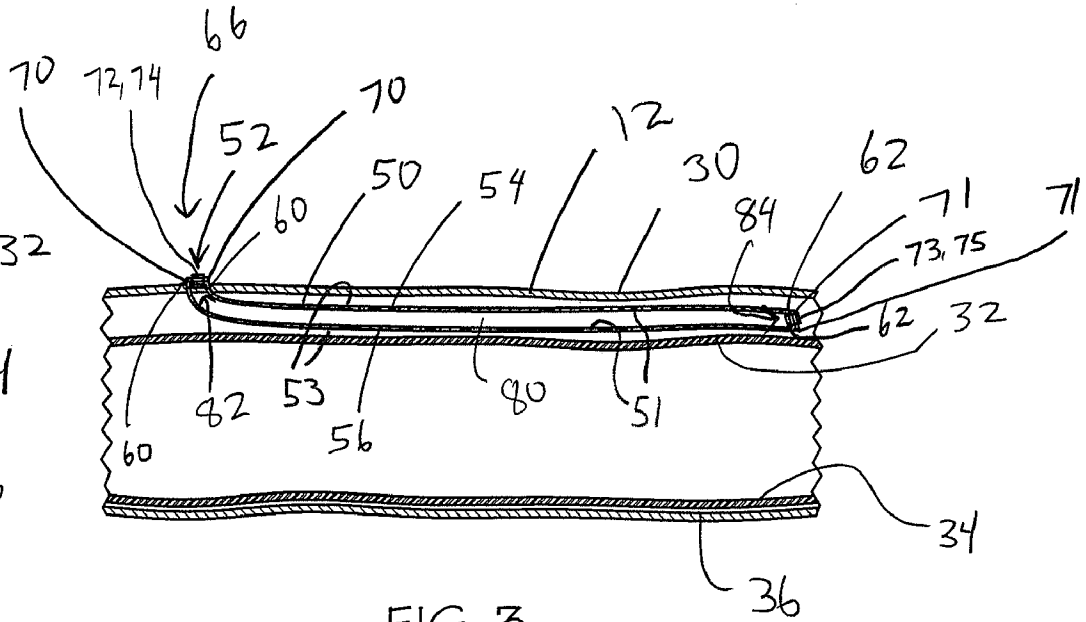
FIG. 3 is a cross section taken along lines 3-3 of FIG. 1.
Figure 2:
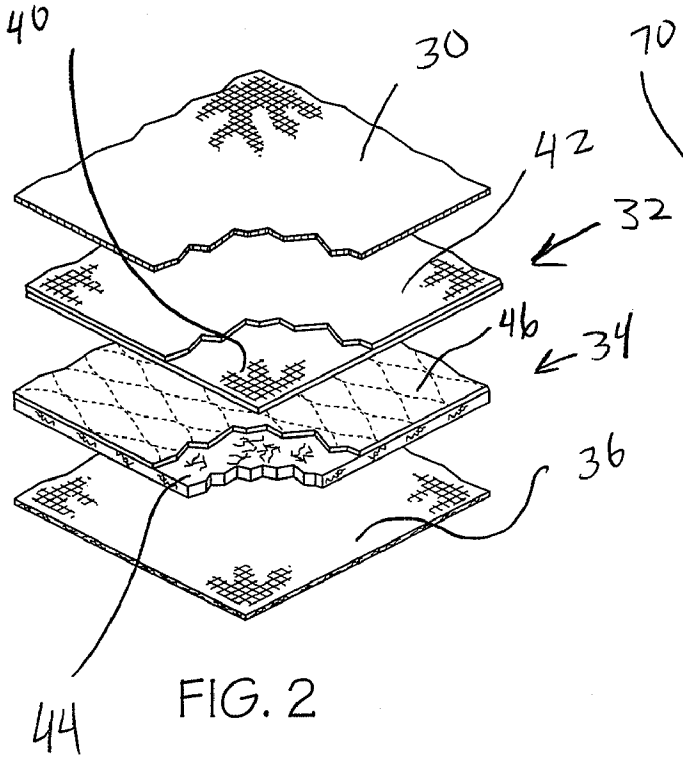
FIG. 2 is a front exploded perspective view illustrating various layers of the garment of FIG. 1.
Figure 4:
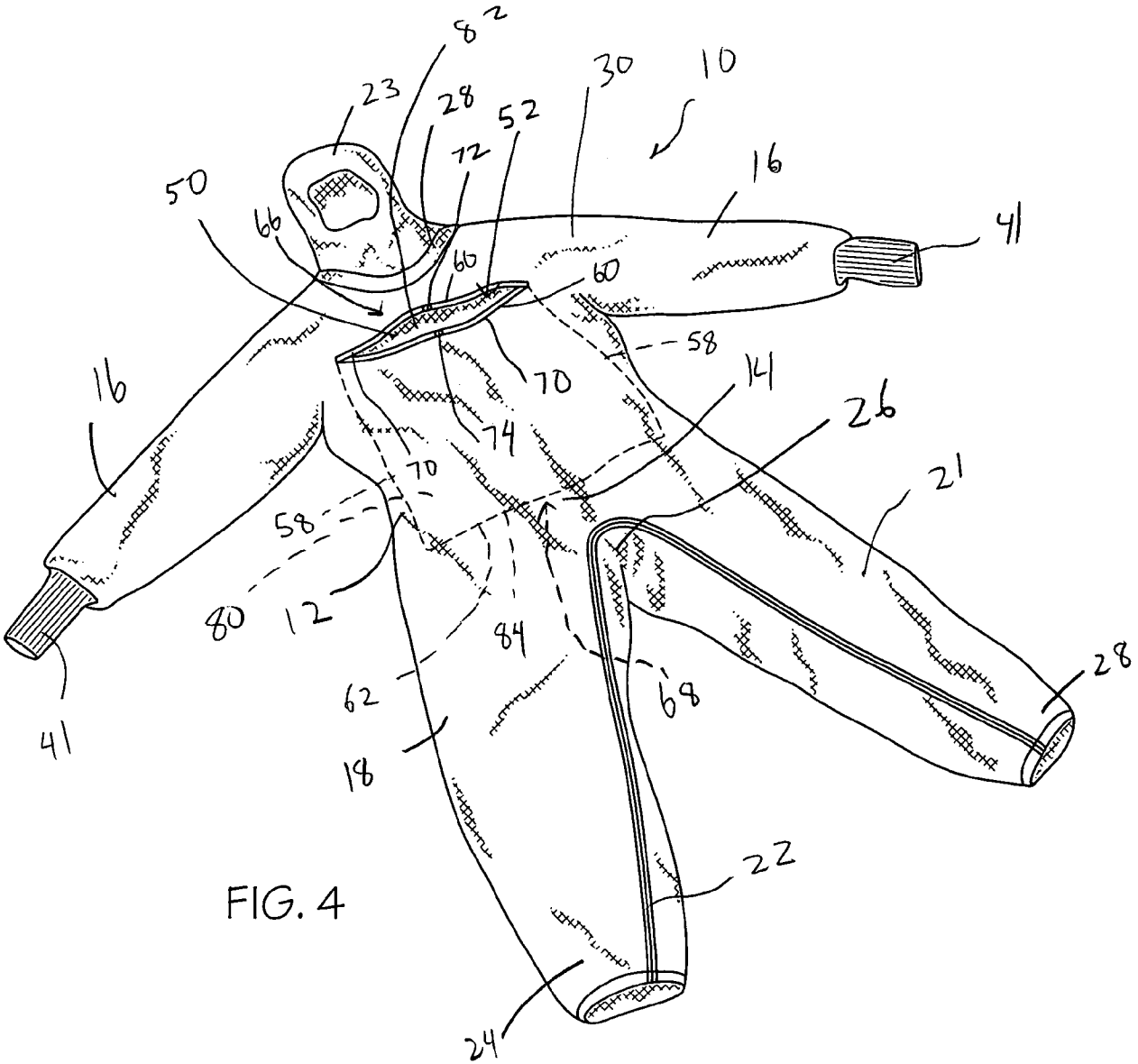
FIG. 4 is a front perspective view of the garment of FIG. 1, shown with the pouch in its open position.

As shown in FIGS. 1-3, the garment 10 may include various layers through the thickness of the garment 10. For example, in the illustrated embodiment, the garment 10 includes an outer shell 30, a moisture barrier 32 located inside of and adjacent to the outer shell 30, a thermal liner or barrier 34 located inside of and adjacent to the moisture barrier 32, and an inner liner or face cloth 36 located inside of and adjacent to the thermal liner 34. The outer shell 30 may be made of or include a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours & Co., Inc.), and commercially available polybenzamidazole fibers including PBI (a trademark of Celanese Corp.) fibers. Thus, the outer shell 30 may be an aramid material, a blend of aramid materials, a polybenzamidazole material, a blend of aramid and polybenzamidazole materials, or other appropriate materials, and may have a weight of, for example, between about 6-10 oz/yd$^2$.

The moisture barrier 32 and thermal liner 34 may be generally coextensive with the outer shell 30, or spaced slightly inwardly from the outer edges (i.e., spaced inwardly from the outer ends of the arms 16, legs 18, 21 and collar 38) of the outer shell 30 to provide moisture and thermal protection throughout the garment 10. The moisture barrier 32 may include a semi-permeable membrane layer 40, which may be generally moisture vapor permeable but generally impermeable to liquid moisture.

The membrane layer 40 may be made of or include expanded polytetrafluoroethylene ("PTFE") such as GORE-TEX or CROSSTECH (both of which are trademarks of W.L. Gore & Associates, Inc.), polyurethane-based materials, neoprene-based materials, cross-linked polymers, polyamid, or other materials. The membrane layer 40 may have microscopic openings that permit moisture vapor to pass therethrough, but block liquids (i.e., water) from passing therethrough. The membrane layer 40 may be made of a microporous material that is either hydrophilic, hydrophobic, or somewhere in between. The membrane layer 40 may also be monolithic and may allow moisture vapor transmission therethrough by molecular diffusion. The membrane layer 40 may also be a combination of microporous and monolithic materials (known as a bicomponent moisture barrier), in which the microporous or monolithic material can be layered or intertwined.

The membrane layer 40 may be bonded or adhered to a substrate 42 of a flame and heat resistant material. The substrate 42 may be aramid fibers similar to the aramid fibers of the outer shell 30, but may be thinner and lighter in weight. The substrate 42 may be woven, non-woven, spunlace or other materials. In the illustrated embodiment, the substrate 42 faces the outer shell 30. However, the orientation of the moisture barrier 32 may be reversed such that the membrane layer 40 faces the outer shell 30.

The thermal liner 34 may be made of any suitable material which provides sufficient thermal insulation. In one embodiment, the thermal liner 34 may include a relatively thick (i.e. typically from 1/16"-3/16" thick) batting, felt or needled non-woven material 44 which can include aramid fiber batting (such as NOMEX batting), aramid needlepunch material, an aramid non-woven material, an aramid blend needlepunch material, an aramid blend batting material, an aramid blend non-woven material, or foam (either open or closed cell) materials. The batting 44 preferably traps air and possesses sufficient loft to provide thermal resistance to the garment 10.

The batting 44 is typically quilted to a thermal liner face cloth 46, and the thermal liner face cloth 46 may be a weave of a lightweight aramid material. Thus, either the batting 44 alone, or the batting 44 in combination with the thermal liner face cloth 46, may be considered to be the thermal liner 34. In one embodiment, the thermal liner 34 may have a thermal protection performance ("TPP") of at least about 20, or of at least about 35. The thermal liner 34 may be treated with a water-resistant material, or may be made of an inherently water-resistant material. In the illustrated embodiment, the thermal liner face cloth 46 faces the moisture barrier 32/outer shell 30. However, the orientation of the thermal liner 34 may be reversed such that the batting 44 faces the moisture barrier 32/outer shell 30.

Although the moisture barrier 32 is shown as being located between the outer shell 30 and the thermal liner 34, the positions of the moisture barrier 32 and thermal liner 34 may be reversed such that the thermal liner 34 is located between the outer shell 30 and the moisture barrier 32.

The face cloth 36 may be the innermost layer of the garment 10 and can provide a comfortable surface for the wearer and protect the batting 44 from abrasion by the wearer. The face cloth 36 may be made of a quilted material as part of a quilt package. The garment 10 may include a pair of wristlets 41, each wristlet being located at the end of an associated arm 16. The wristlets 41 and hood 23 may be made of a woven material knitted from a flame and heat resistant material including aramid materials, a blend of aramid materials, a polybenzamidazole material, or a blend of aramid and polybenzamidazole materials. The wristlets 41 may include an elastic material included or stitched therein.

Each layer of the garment 10, and the garment as a whole, may be designed to meet the National Fire Protection Association ("N.F.P.A.") 1971 standards for protective firefighting garments ("Protective Clothing for Structural Firefighting"). The NFPA standards specify various minimum requirements for heat and flame resistance and tear strength. For example, in order to meet the NFPA standards, an outer shell 30 of a garment must be able to resist igniting, burning, melting, dripping and/or separation at a temperature of 500° F. for at least five minutes. Furthermore, in order to meet the NFPA standards, all combined layers of the garment 10 must provide a thermal protection performance rating of at least thirty five. However, if desired the garment 10 may have a thermal protection performance of less than thirty five, or may not meet various other NFPA standards, in which case the garment 10 may be sold or marketed as not necessarily meeting NFPA standards. For example, the garment 10 may be a recreational snow suit or have various other uses.

The garment 10 may include a storage pouch 50 which is directly or indirectly coupled to the outer shell 30. The outer shell 30 may include a slit or opening 52 therein to provide access to the inner cavity 80 of the pouch 50. The storage pouch 50 may include a pair of opposed panels of material 54, 56 (FIG. 3) which are fixedly coupled together along their side edges 58 (FIGS. 1 and 5), such as by stitching. The storage pouch 50 has an inner surface 51 formed in a generally closed loop tubular shape and an outer surface 53 formed in a generally closed loop tubular shape. The opposed panels 54, 56 may be made of a variety of materials, such as the same materials outlined above for the outer shell 30.

The pouch 50 may include an upper fastening mechanism 66 and a lower fastening mechanism 68 for releasably coupling the opposed panels 54, 56 together along their top 60 and bottom edges 62. For example the upper fastening mechanism 66 may include a strip 70 of hook-and-loop fastening material (such as VELCRO®) located at, on or adjacent to the upper edge 60 of the panel 54 and another strip 70 located on, at, or adjacent to the upper edge 60 of panel 56. The upper fastening mechanism 66 may also include a male snap component 72 located on, at, or adjacent to the upper edge 60 of panel 56 and a female snap component 74 located on, at, or adjacent to the upper edge 60 of panel 54.

The lower fastening mechanism 68 may include a strip 71 of hook-and-loop fastening material (such as VELCRO®) located on, at, or adjacent to the lower edge 62 of the panel 54 and another strip 71 of hook-and-loop fastening material located on, at or adjacent to the lower edge 62 of panel 56. The lower fastening mechanism 68 may also include a male snap component 73 located on, at, or adjacent to the lower edge 62 of panel 56 and a female snap component 75 located on, at, or adjacent to the lower edge 62 of panel 54. In this manner, the upper fastening mechanism 66 can be operated by pressing the strips 70 of hook-and-loop fastening material together and/or by pressing the snap components 72, 74 together. The lower fastening mechanism 68 can similarly be operated by pressing the strips 71 of hook-and-loop fastening material together and/or by pressing the snap components 73, 75 together. The upper 66 and lower 68 fastening mechanisms can also be operated to open the mouths 82, 84 by pulling the associated components of the fastening mechanism apart.

The pouch 50 includes the inner cavity 80 located between the panels 54, 56, and the pouch 50 includes a generally closed loop shape upper mouth 82 (i.e. located adjacent to or between the top edges 60) and a generally closed loop shape lower mouth 84 (i.e. located adjacent to or between the bottom edges 62). The upper mouth 82 may generally coincide with the slit 52 in the outer shell 30. A wide variety of fastening devices (besides the snaps 72, 74, 73, 75 and patches of hook-and-loop fastening material 70, 71) including but not limited to slide fastener components, snaps, buttons, hooks, loops, ties and the like may be used to as the fastening mechanisms 66, 68.

The pouch 50 may be fixedly coupled to the outer shell 30. For example, the top edges 60 may be fixedly coupled to the outer shell 30 (i.e. by stitching) such that the upper mouth 82 is coupled to the outer shell 30 about is periphery. As shown in FIG. 3, in the illustrated embodiment the pouch 50 is located immediately adjacent to the outer shell 30 such that the pouch 50 is located between the outer shell 30 and the moisture barrier 32, and between the outer shell 30 and the thermal liner 34.

Figure 5:
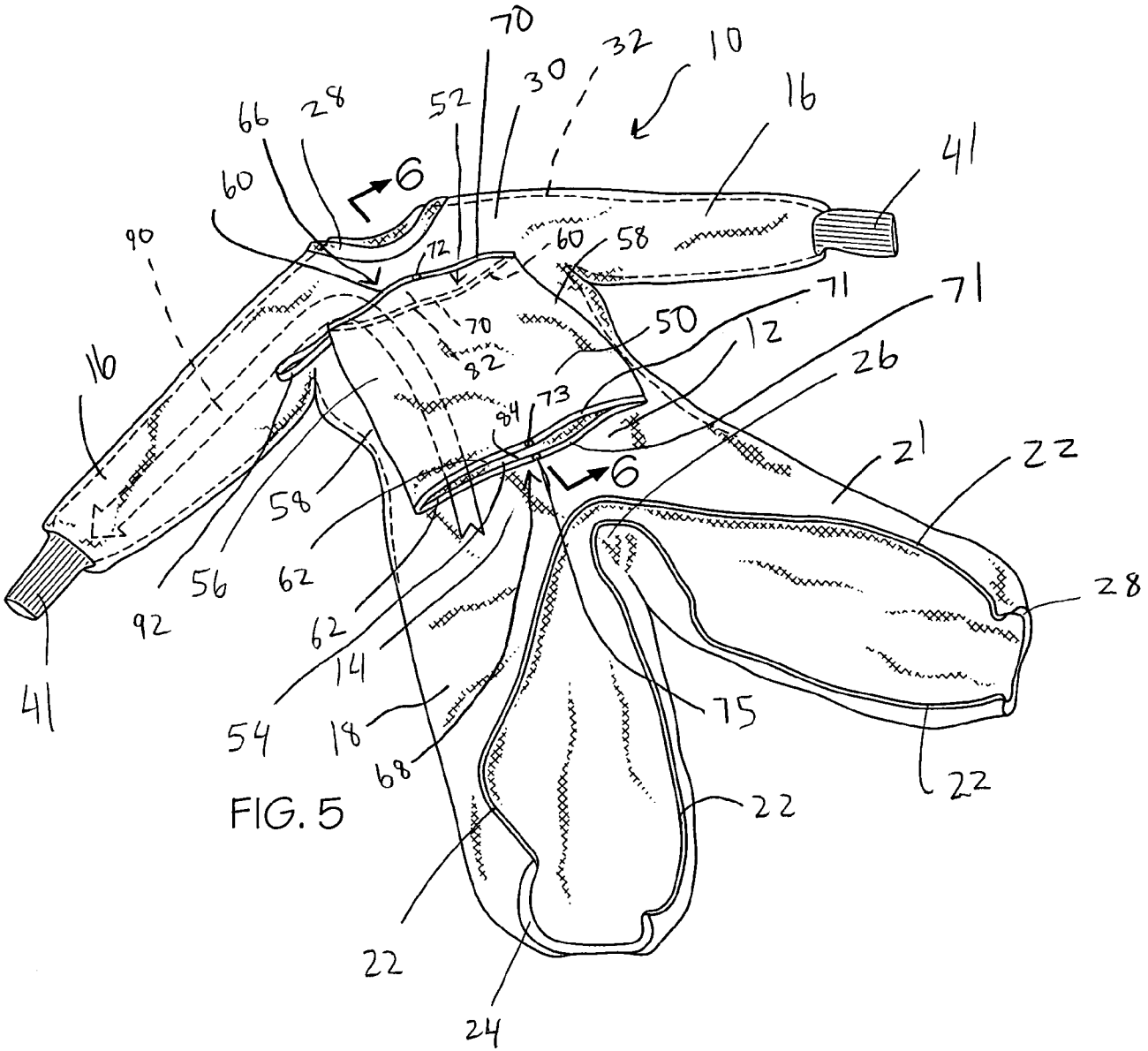
FIG. 5 is a front perspective view of the garment of FIG. 4, with the pouch in its external position.
Figure 6:
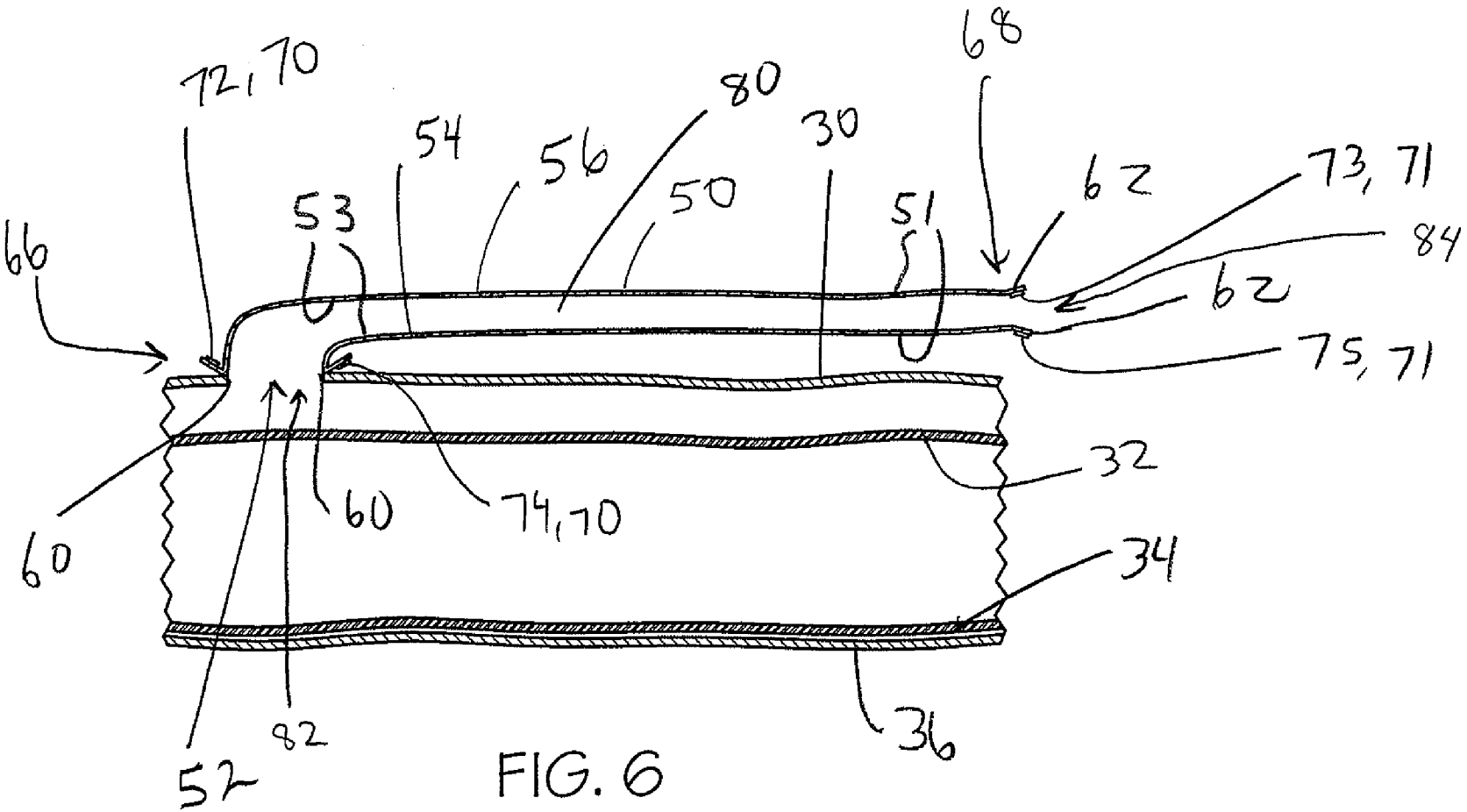
FIG. 6 is a cross section taken along lines 6-6 of FIG. 5.

FIGS. 1 and 3 illustrate the pouch 50 in an internal position wherein the pouch 50 is located generally inside of the outer shell 30. In this configuration, the inner cavity 80 of the pouch 50 can be accessed, if desired, via the upper mouth 82. In order to store the garment 10 inside the pouch 50, the pouch 50 is moved to its external position shown in FIGS. 5 and 6 wherein the pouch 50 is located generally outside of the outer shell 30. In order to move the pouch 50 to this configuration, a user reaches through the upper mouth 82 and pulls the pouch 50 outside of the inner shell 30, thus "inverting" the pouch 50 in the process such that the inner surface 51 is located outside the outer surface 53. Next, if not already done so, the lower fastening mechanism 68 is operated (i.e. by pulling the bottom edges 62 apart) so that the bottom edges 62 of the pouch 50 are separated to open the lower mouth 84, thereby moving the pouch 50 into its sleeve-like configuration shown in FIGS. 5 and 6. The zipper 22 is opened to move the legs 18,21 to their open position and the hood 23 is then inverted and stuffed into the inner cavity of the garment 10 as shown in FIG. 5.

Figure 7:
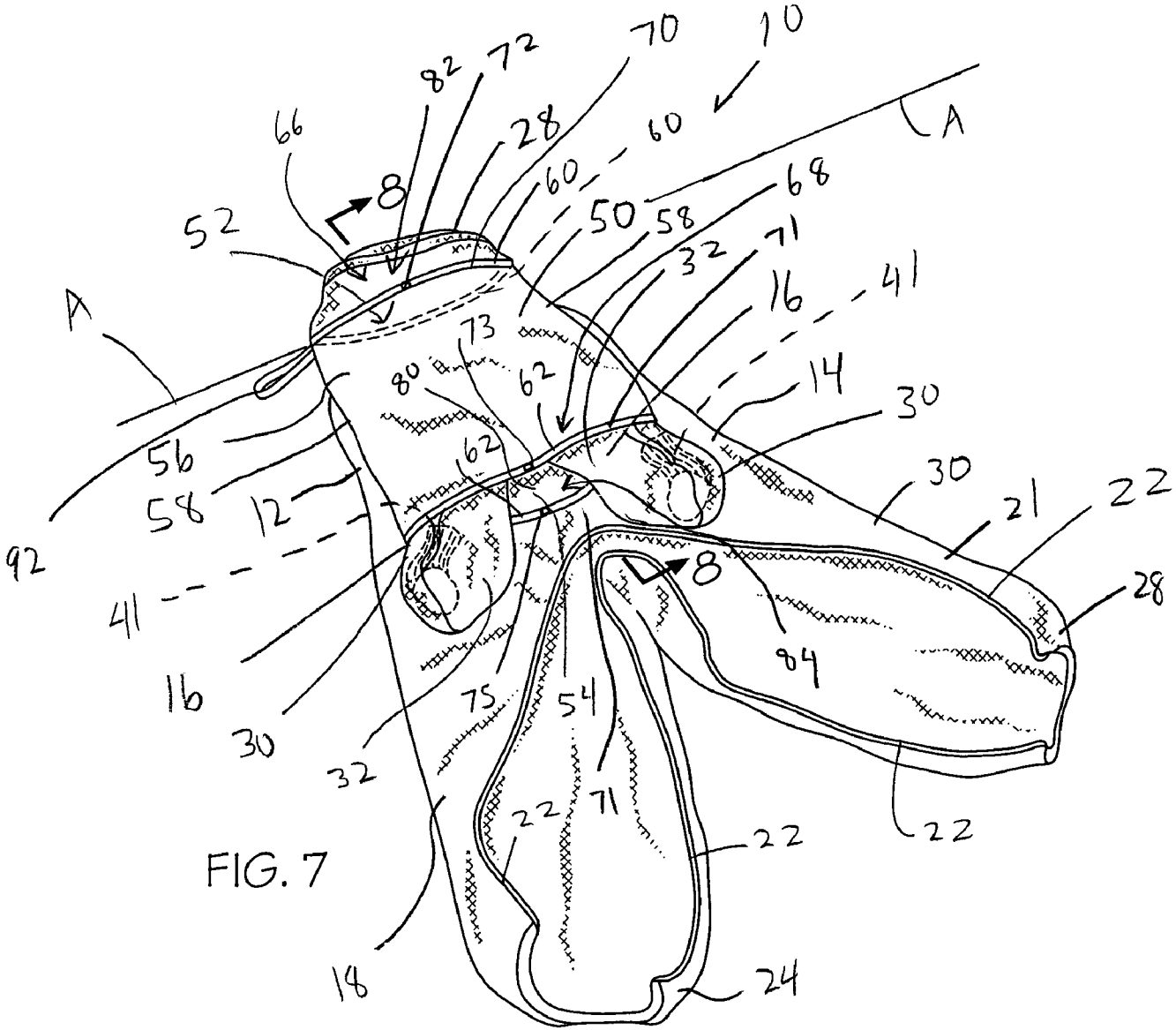
FIG. 7 is a front perspective view of the garment of FIG. 5, with the arms of the garment pulled into the pouch.
Figure 8:
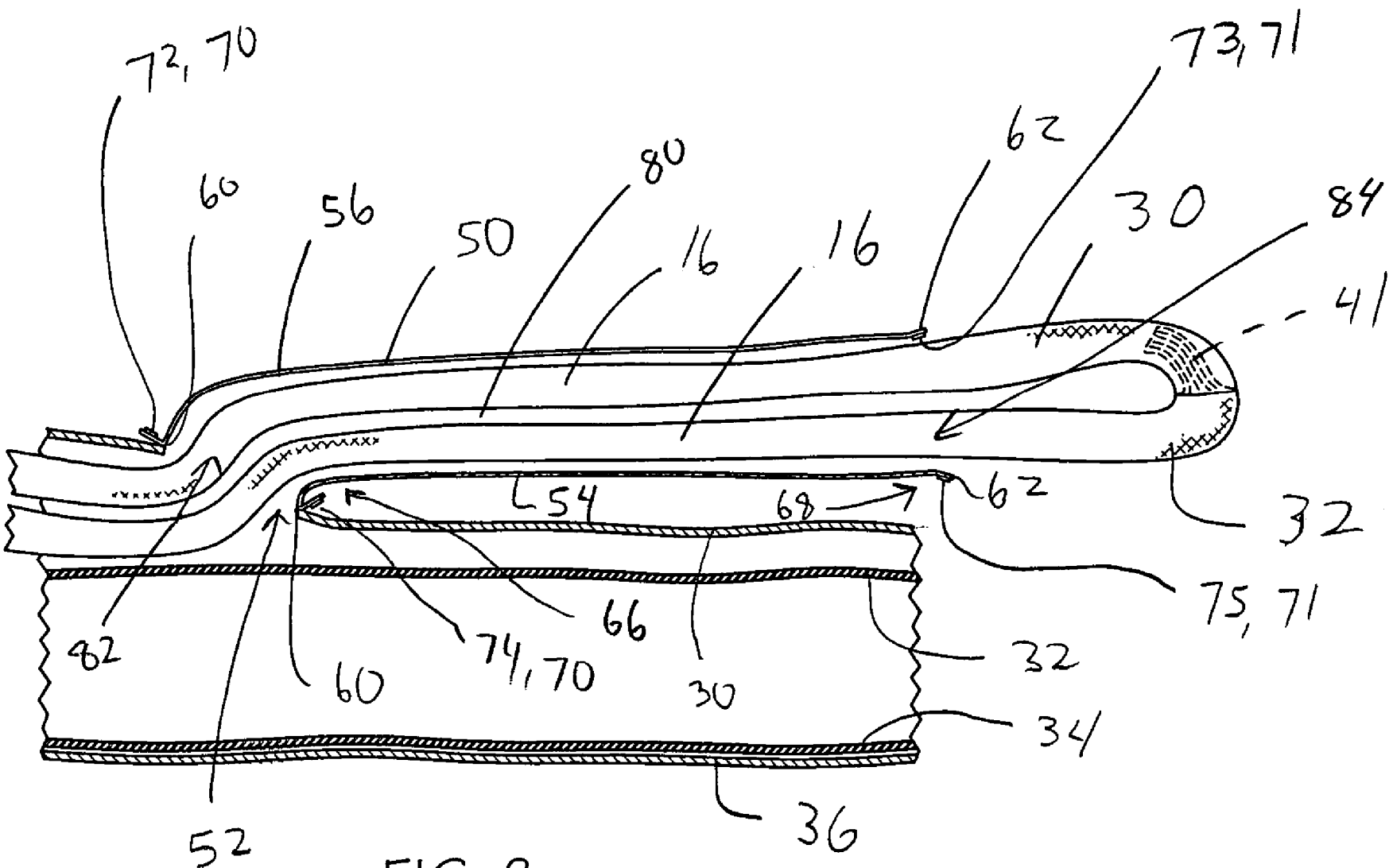
FIG. 8 is a cross section taken along lines 8-8 of FIG. 7.

The user then reaches through the lower mouth 84 of the pouch 50, through the upper mouth 82 and down one of the sleeves or arms 16 of the garment 10. At this point, the user's arm is located between the outer shell 30 and the moisture barrier 32 of the garment 10. The path of access (i.e., the path in which a user will insert his or her arm) is shown as arrow 90 in FIG. 5. The user then grasps the garment (i.e., either the moisture barrier 32 and/or outer shell 30) at the tip of the arrow 90 and pulls the arm 16 of the garment 10 through the upper mouth 82 and at least partially through the lower mouth 84 of the pouch 10. As the user pulls the arm 16 through the upper 82 and lower 84 mouths, the arm 16 will be inverted and the outer shell 30 of each arm 16 will be separated from the moisture barrier 32, thermal liner 34 and face cloth 46 of that arm because the outer shell 30 and moisture barrier 32 are joined at or adjacent to the wristlet 41 of each arm 16. This inverting step is then repeating for the remaining arm 16. As can be seen in FIGS. 7 and 8, each arm 16 may form a generally "looped" shape when inverted in this manner with part of the loop formed by the outer shell 32 and part of the loop formed by the remaining components (i.e. moisture barrier 32, thermal liner 34 and face cloth 46) of the arm 16.

Figure 9:
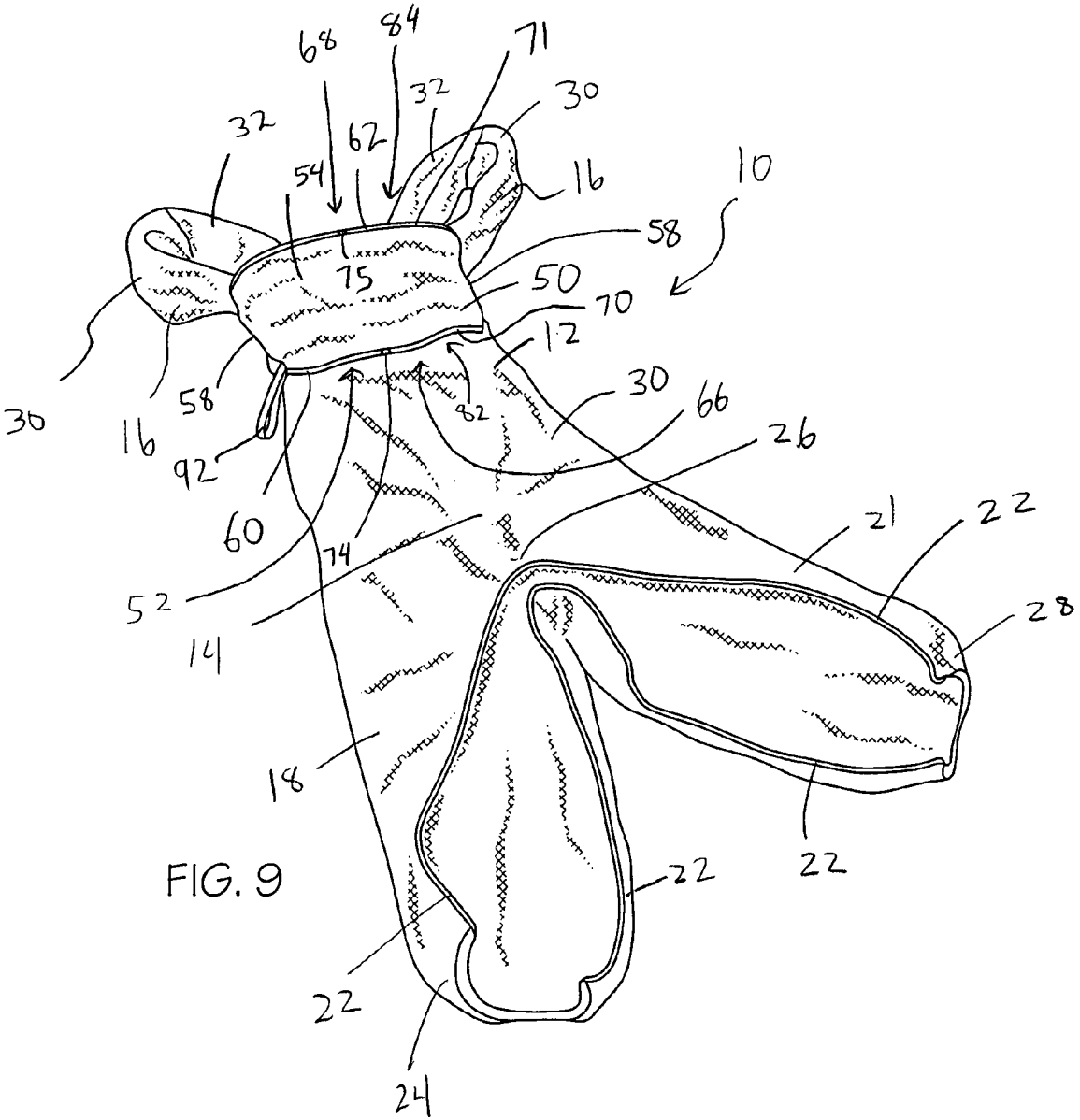
FIGS. 9-12 are a series of front perspective views showing the remaining steps for folding the garment into the pouch.
Figure 10:
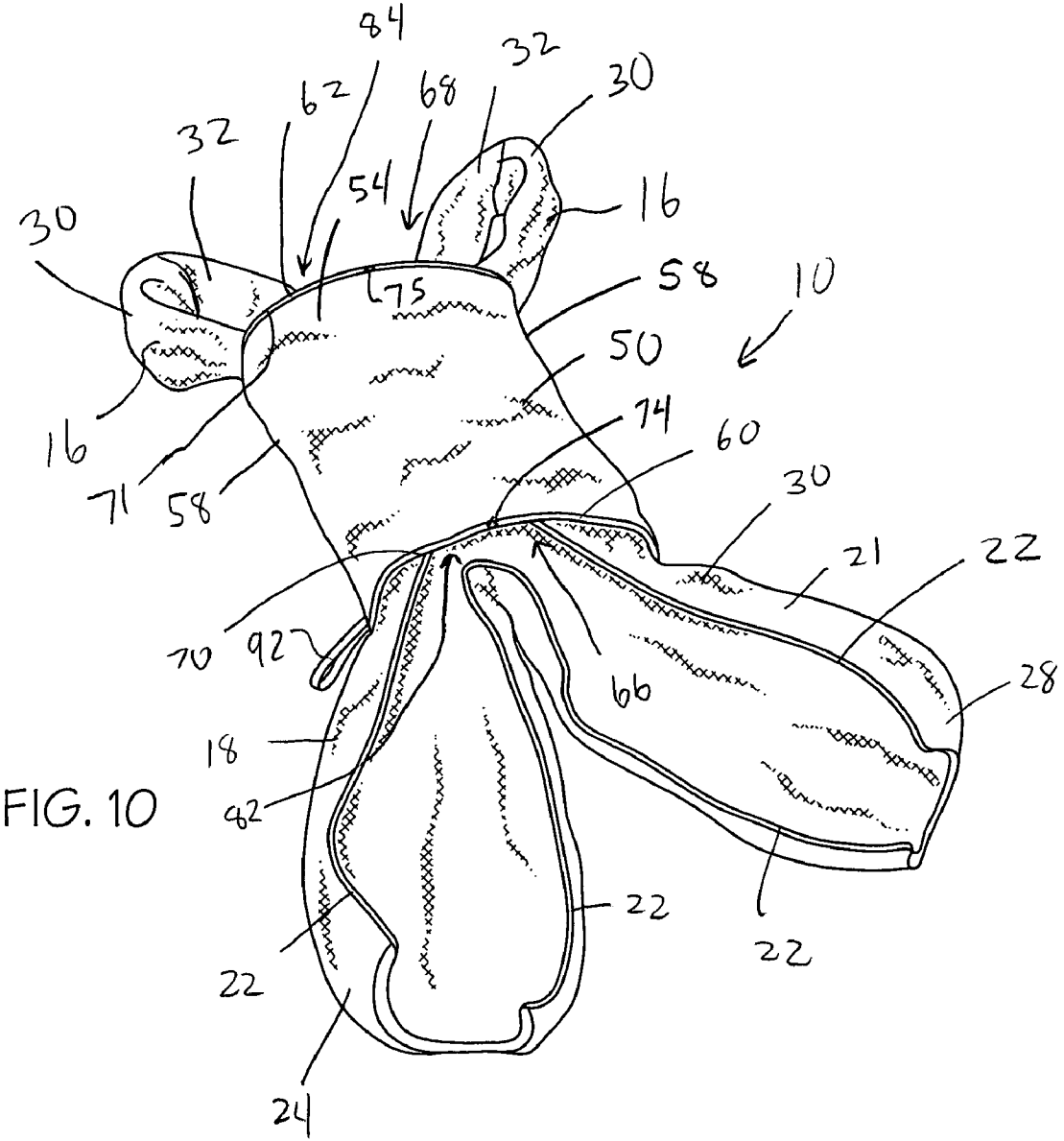

FIGS. 7 and 8 illustrate the garment 10 after both arms 16 have been inverted and folded into the pouch 50. Next, the pouch 50 is "flipped" or pivoted about a hinge line A (FIG. 7) located adjacent to the upper edges 60 until the pouch 50 is located in its configuration shown in FIG. 9. In this configuration, the lower mouth 84 is actually located above the upper mouth 82. Next, as shown in FIG. 10, the torso portion 12 of the garment 10 is stuffed into the pouch 50 through the upper mouth 82. The torso portion 12 should be forced to the lower mouth 84 of the pouch 50 as much as possible during this step. Furthermore, it is helpful to ensure that the pouch 50 remains in a generally cylindrical shape while inserting the torso portion 12 into the pouch 50 at this stage.

Figure 11:
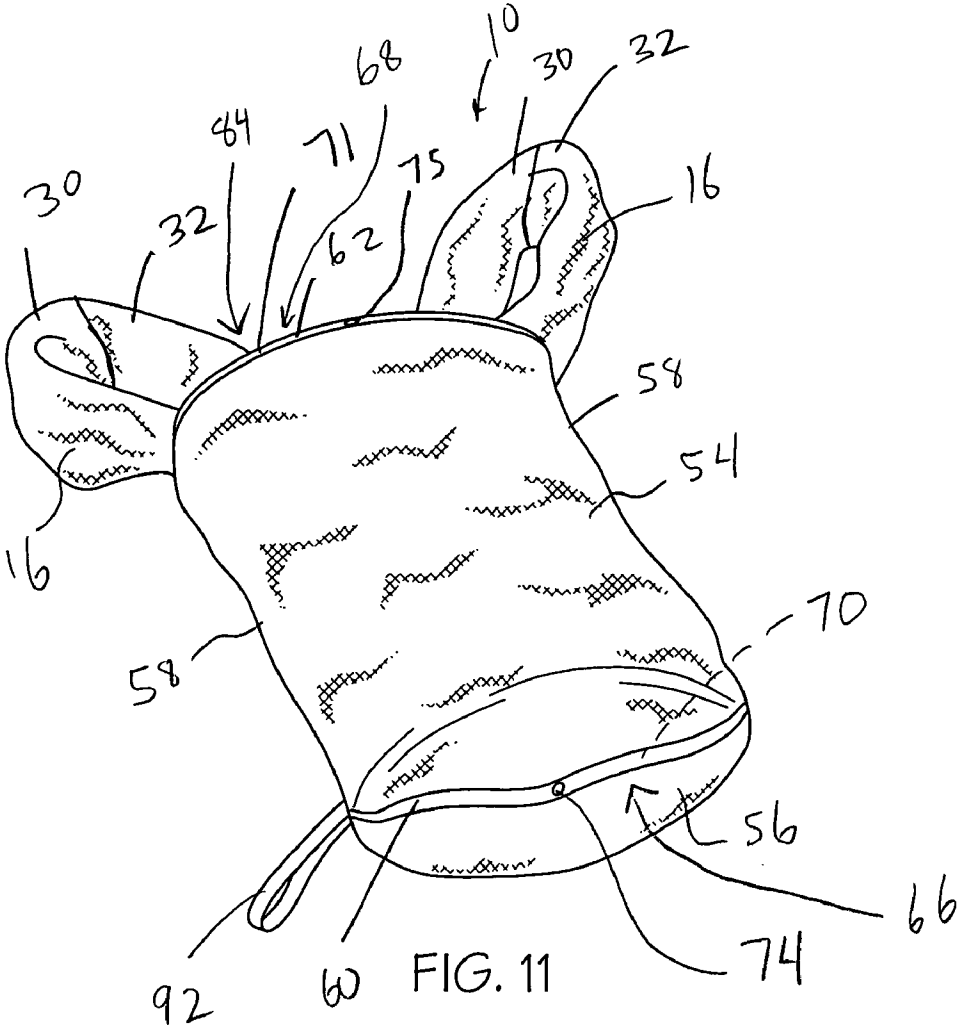

Once the torso portion 12 is received in the pouch 50, the bottom of each leg 18, 21 may be inserted and stuffed into the pouch 50 through the upper mouth 82 until the legs 18, 21 are entirely received inside the pouch 50. As shown in FIG. 11, the upper mouth 82 of the pouch 50 is then closed, such as by operating the upper fastening mechanism 66 (i.e. engaging the strips of hook-and-loop fastening material 70 and the snaps 72, 74). Finally, the portions of the arms 16 protruding through the lower mouth 84 are inserted into the pouch 50 via the lower mouth 84. The lower mouth 84 of the pouch is then closed, such as by operating the lower fastening mechanism 68 (i.e. engaging the strips of hook-and-loop fastening material 71 and the snaps 73, 75).

Figure 12:
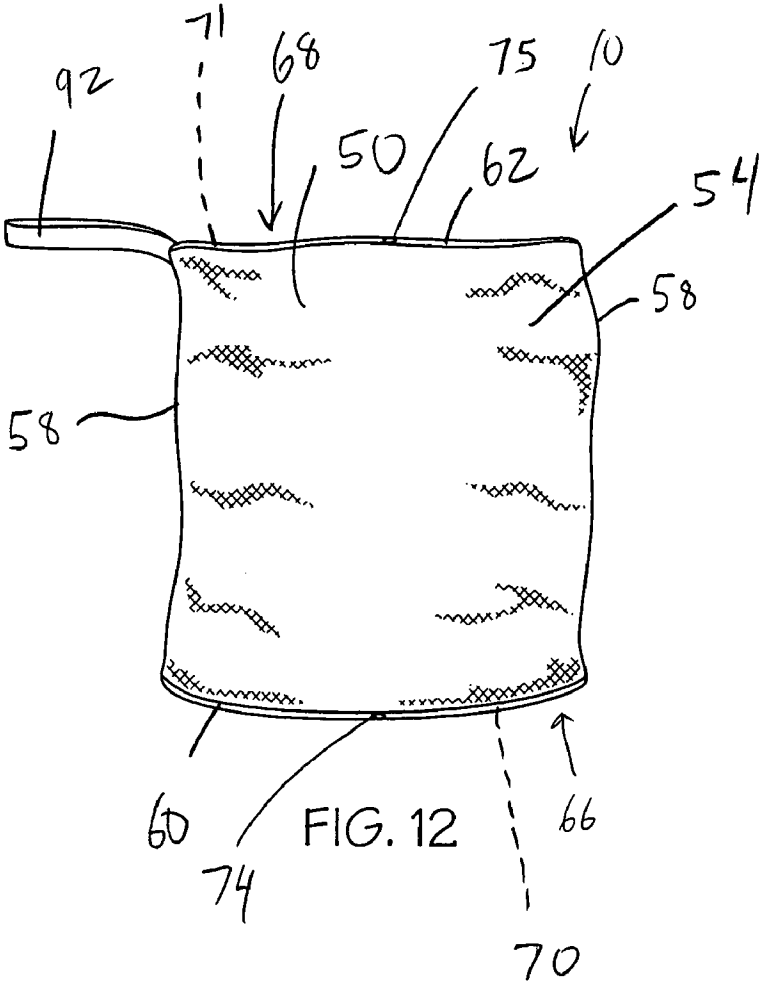

The resultant, folded garment is shown in FIG. 12. The pouch 50 may then be firmly compressed by the folder to force the bag to become somewhat flat. The pouch 50 may include a handle 92 securely coupled thereto to provide for easy carrying and/or hanging of the garment 10.

In order to remove the suit 10 from the pouch 50 for wearing, the upper mouth 82 of the garment 10 is opened by operating the upper fastening mechanism 66. The legs 18, 21 and torso portion 12 of the garment 10 are then pull out of the pouch 50. The user then reaches into the pouch 50 and through one of the arms 16 until a wristlet 41 is located by feel. The wristlet 41 is then grasped and pulled to pull the arm 16 out of the pouch 50, thereby re-inverting the arm 16 to its normal position. The remaining arm 16 is then extracted in the same manner. The hood 23 is then pulled out of the body cavity of the garment 10, and the pouch 50 stuffed through the slit 52 of the outer shell 30 such that the pouch 50 is located generally inside of the outer shell 30. Finally, the upper mouth 82 of the pouch is closed by operating the upper fastening mechanism 66, and the zipper 22 is zipped thus returning the garment 10 to its form shown in FIG. 1.

Thus, the pouch 50 provides a convenient and useful mechanism for storing the garment 10 therein and protects the garment 10 from sunlight as well as various other harmful chemicals, fumes and the like. The upper 82 and lower 84 mouths and upper 66 and lower 68 fastening mechanisms enable the pouch 50 to be moved to its generally sleeve-like configuration wherein the user can reach through the lower mouth 84 and open mouth 82 to invert the arms 16, and allows the arms 16 to protrude through the lower mouth 84. Thus this configuration of the pouch 50 provides greatly increased access for folding and unfolding of the garment 50 into and out of the pouch 50. The pouch 50 may also be used as a storage well for storing various loose items, such as gloves, goggles, etc.

Having described the invention in detail and by reference to the preferred embodiments, it will be apparent that modifications and variations thereof are possible without departing from the scope of the invention.

What is claimed is:

1. A foldable protective garment comprising:

an outer shell shaped to fit about the arms, chest, torso and legs of the body of a wearer, said outer shell being foldable into a compact position; and a pouch defining a generally closed shape having an inner volume and coupled to said outer shell, said pouch being shaped and sized to receive generally all of said outer shell in said inner volume when said outer shell is in said compact position, said pouch including an upper mouth and a lower mouth located on a generally opposite side of said pouch relative to said upper mouth, wherein said upper mouth and said lower mouth are both selectively openable and closable, and wherein said pouch is movable between an internal position wherein said pouch is generally located inside said outer shell and an external position wherein said pouch is generally located outside said outer shell, and wherein when said pouch is in said internal position said pouch has an inner surface formed in a generally closed loop tubular shape and an outer surface formed in a generally closed loop tubular shape, and wherein when said pouch is in said external position said pouch is located in an inverted configuration wherein said inner surface is located outside said outer surface.

2. The garment of claim 1 further comprising a lower fastening mechanism for selectively closing said lower mouth.

3. The garment of claim 2 wherein said lower fastening mechanism includes a plurality of patches of hook and loop fastening material located adjacent to said lower mouth to enable said selective opening and closing of said lower mouth.

4. The garment of claim 1 further comprising an upper fastening mechanism for selectively closing said upper mouth.

5. The garment of claim 4 wherein said upper fastening mechanism includes a plurality of patches of hook and loop fastening material located adjacent to said upper mouth to enable said selective opening and closing of said upper mouth.

6. The garment of claim 1 wherein said mouth is a generally closed loop shape and said pouch is directly fixedly coupled to said outer shell generally around the entire perimeter of said upper mouth.

7. The garment of claim 1 wherein said pouch is configured as a generally tubular sleeve when said upper mouth and said lower mouth are entirely open.

8. The garment of claim 1 wherein said pouch is configured to generally entirely receive and retain said outer shell therein when said outer shell is in said compact position and placed into said pouch and said upper and lower mouths are closed.

9. The garment of claim 1 wherein said outer shell is made from a single integral piece of material.

10. The garment of claim 1 wherein said pouch is fixedly and non-removably coupled to said outer shell.

11. The garment of claim 1 wherein said upper mouth and said lower mouth are spaced apart and communicate with each other via said inner volume.

12. The garment of claim 1 wherein said outer shell includes a back portion configured to lie adjacent to the back of a wearer and a front portion configured to lie adjacent the front of a wearer, and wherein said pouch is coupled to said front portion of said outer shell.

13. The garment of claim 1 wherein said pouch is configured and located such that said pouch can be accessed by a wearer of said garment when said garment is worn.

14. The garment of claim 1 wherein said upper mouth defines a closed loop shape and said lower mouth defines a closed loop shape.

15. The garment of claim 1 wherein said garment includes a pair of legs.

16. The garment of claim 1 wherein said upper mouth and said lower mouth are both independently openable and closable relative to each other.

17. The garment of claim 1 wherein said pouch is generally tubular.

18. A foldable protective garment comprising:

an outer shell shaped to fit about the arms, chest, torso and legs of the body of a wearer, said outer shell being foldable into a compact position; and a pouch coupled to said outer shell, said pouch being shaped and sized to receive generally all of said outer shell therein when said outer shell is in said compact position, said pouch including an upper mouth and a lower mouth located on a generally opposite side of said pouch relative to said upper mouth, wherein said upper mouth and said lower mouth are both selectively openable and closable wherein said garment includes a pair of legs, and wherein said garment includes a fastener extending from an ankle of one of the pair of legs, across a crotch of said garment, and to an ankle of the other leg so that said garment can be opened and donned over the head of a wearer.

19. The garment of claim 1 wherein said outer shell is abrasion, flame and heat resistant.

20. The garment of claim 19 wherein said outer shell can resist igniting, burning, melting, dripping or separation at a temperature of 500° F for at least five minutes.

21. The garment of claim 19 wherein said outer shell includes a material selected from a group of consisting of an aramid material, a blend of aramid materials, a polybenzamidazole material, and a blend of aramid and polybenzamidazole materials.

22. The garment of claim 19 further comprising a moisture barrier located generally inside of said outer shell such that when said garment is worn said moisture barrier is located generally between said outer shell and a wearer of said garment, said moisture barrier being generally co-extensive with said outer shell and being made of a material that is generally liquid impermeable and generally moisture vapor permeable.

23. The garment of claim 22 wherein said moisture barrier includes expanded polytetrafluoroethylene.

24. The garment of claim 22 further comprising a thermal liner located generally inside said outer shell such that when said garment is worn said thermal liner is located generally between said outer shell and a wearer of said garment.

25. The garment of claim 24 wherein said moisture barrier is generally located between said outer shell and said thermal liner.

26. The garment of claim 24 wherein said thermal liner includes a material selected from a group consisting of an aramid needlepunch material, an aramid batting material, an aramid non-woven material, an aramid-blend needlepunch material, an aramid-blend batting material and an aramid-blend non-woven material.

27. The garment of claim 24 further comprising a face cloth layer located inside of said thermal liner and located to be the innermost layer of said garment.

28. A method for storing a protective garment comprising the steps of:

providing a protective garment having an outer shell shaped to fit about at least part of the torso of a wearer, said outer shell including a pair of pant legs shaped to fit about the legs of a wearer, said garment including a pouch coupled to said outer shell, said pouch having an upper mouth and a lower mouth, wherein each mouth is a generally closed loop shape and said pouch is fixedly coupled to said outer shell generally around the perimeter of said upper mouth, and wherein said pouch is located in an internal position wherein said pouch is generally located inside said outer shell, and wherein when said pouch is in said internal position said pouch has an inner surface formed in a generally closed loop tubular shape and an outer surface formed in a generally closed loop tubular shape;

opening said upper mouth and said lower mouths such that said pouch is in a generally sleeve-like configuration;

moving said pouch to an external position wherein said pouch is generally located outside said outer shell, wherein when said pouch is in said external position said pouch is located in an inverted configuration wherein said inner surface is located outside said outer surface; and folding said garment into said pouch such that generally all of said outer shell is located in said pouch.

29. The method of claim 28 further comprising the step of, after said folding step, closing said upper and lower mouths.

30. The method of claim 28 wherein said upper mouth is located on a generally opposite side of said pouch relative to said lower mouth.

31. The method of claim 28 wherein said folding step includes arranging said garment such that said garment extends at least partially through both of said mouths.

32. The method of claim 28 wherein said outer shell is abrasion, flame and heat resistant and can resist igniting, burning, melting, dripping or separation at a temperature of 500° F for at least five minutes.

33. The method of claim 28 wherein said upper mouth and said lower mouth are spaced apart and communicate with each other via said inner volume.

34. The method of claim 28 wherein said outer shell includes a back portion configured to lie adjacent to the back of a wearer and a front portion configured to lie adjacent the front of a wearer, and wherein said pouch is coupled to said front portion of said outer shell.

35. The method of claim 28 wherein said outer shell is shaped to fit about the arms, chest, torso and legs of the body of a wearer.

36. The method of claim 28 wherein said pouch is configured and located such that said pouch can be accessed by a wearer of said garment when said garment is worn.

37. The method of claim 28 wherein said pouch defines a generally closed shape having an inner volume, and wherein said upper mouth and said lower mouth are both independently openable and closable.

38. The method of claim 28 wherein said pouch is generally tubular after said opening step.

39. A method for storing a protective garment comprising the steps of:

providing a protective garment having an outer shell shaped to fit about at least part of the torso and legs of a wearer and pouch coupled to said outer shell, said pouch having an upper mouth and a lower mouth;

opening said upper mouth and said lower mouths such that said pouch is in a generally sleeve-like configuration;

folding said garment into said pouch such that generally all of said outer shell is located in said pouch, wherein said folding step includes arranging said garment such that said garment extends at least partially through both of said mouths, wherein said upper mouth is coupled to said outer shell generally about the entire perimeter of said upper mouth, and wherein at least one arm of said garment extends through said lower mouth during said folding step.

40. A method for storing a protective garment comprising the steps of:

providing a protective garment having an outer shell shaped to fit about at least part of the torso of a wearer, said outer shell including a pair of pant legs shaped to fit about the legs of a wearer, said garment including a pouch coupled to said outer shell, said pouch having an upper mouth and a lower mouth;

opening said upper mouth and said lower mouths such that said pouch is in a generally sleeve-like configuration;

folding said garment into said pouch such that generally all of said outer shell is located in said pouch, wherein said pouch is located in an internal position wherein said pouch is generally located inside said outer shell during said providing step, and wherein the method includes the step of, prior to said folding step, moving said pouch to an external position wherein said pouch is generally located outside said outer shell, and wherein said outer shell is shaped to fit over the arms, chest, torso and legs of a wearer, and wherein said folding step includes inverting both of said arms of said outer shell such that at least part of each arm is passed through both mouths of said pouch.

41. The method of claim 40 further comprising the step of, after said inverting step, inserting said torso portion of said outer shell into said pouch and then inserting said legs of said outer shell into said pouch.

* * * * *